US006800159B2

(12) United States Patent
Itoh

(10) Patent No.: US 6,800,159 B2
(45) Date of Patent: Oct. 5, 2004

(54) METHOD OF BONDING AND SEWING CLOTHS

(75) Inventor: Mitsuru Itoh, Seinan Manshon #604, 8-15 4-chome, Minamiaoyama, Minato-ku, Tokyo 107 (JP)

(73) Assignee: Mitsuru Itoh, Tokyo (JP)

( * ) Notice: Subject to any disclaimer, the term of this patent is extended or adjusted under 35 U.S.C. 154(b) by 236 days.

(21) Appl. No.: 09/912,457

(22) Filed: Jul. 26, 2001

(65) Prior Publication Data

US 2002/0014300 A1 Feb. 7, 2002

(30) Foreign Application Priority Data

Aug. 2, 2000 (JP) ..... 2000-234333
Dec. 28, 2000 (JP) ..... 2000-400120

(51) Int. Cl.[7] ..... B32B 7/08

(52) U.S. Cl. ..... 156/93; 112/413; 112/415; 139/DIG. 1; 156/256; 156/260; 156/263; 428/102; 442/246

(58) Field of Search ..... 156/91, 92, 93, 156/163, 164, 148, 229, 256, 260, 263; 428/102, 103, 104, 175; 2/274, 275; 442/183, 239, 246, 255, 263, 242, 260, 328; 112/418, 475.01, 475.08, 475.09, 413, 415; 139/DIG. 1

(56) References Cited

U.S. PATENT DOCUMENTS 2,115,254 A * 4/1938 Van Cleef ..... 428/124
2,184,772 A * 12/1939 Vamos ..... 442/183
4,410,577 A * 10/1983 Palmer et al. ..... 428/85
4,622,254 A * 11/1986 Nishimura et al. ..... 428/102

* cited by examiner

*Primary Examiner*—Gladys JP Corcoran

(57) ABSTRACT

In a method of cutting a cloth of the invention, a cloth woven by warps and wefts is cut at 45 to 55 degrees to divide the cloth into a left-to-right cutting bias portion and a right-to-left cutting bias portion as bias cloths. The left-to-right cutting bias portion has a left-to-right stretching direction, and the right-to-left cutting bias portion has a right-to-left stretching direction. Then, the right-to-left cutting bias portion and the left-to-right cutting bias portion are cut into bias front cloths, bias adhesive core pieces, bias adhesive tapes, and bias linings. By crossing the bias core pieces or the like having the different stretching directions and bonding to a stretchable cloth, a stable stretchability and tension can be given to the stretchable cloth.

5 Claims, 10 Drawing Sheets

Fig. 1(a)
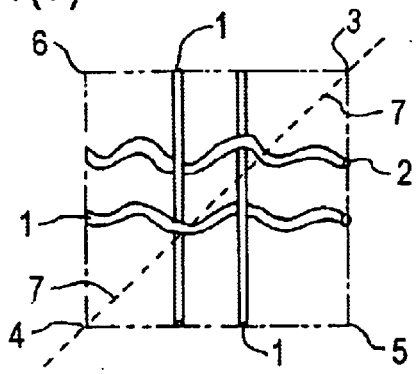
Fig. 1(b)
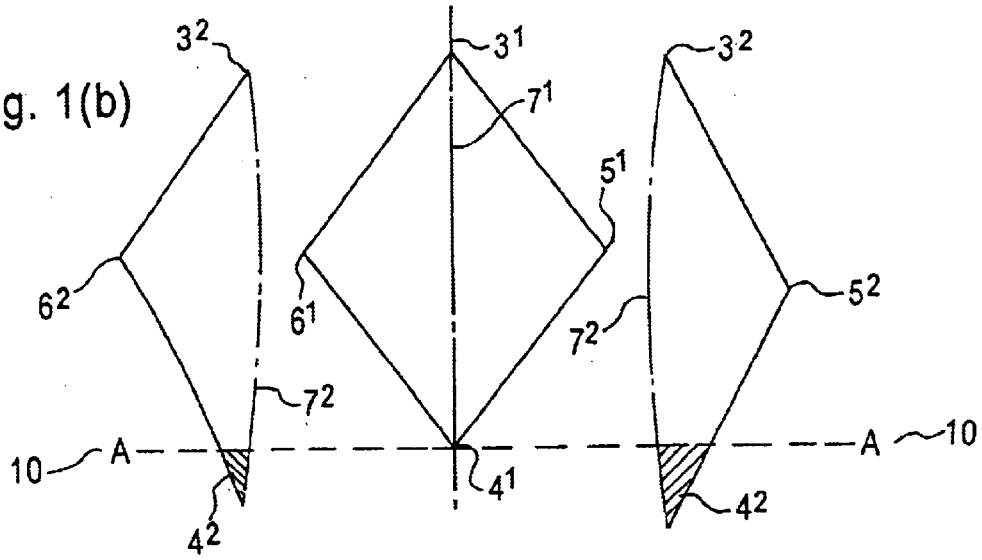
Fig. 1(c)
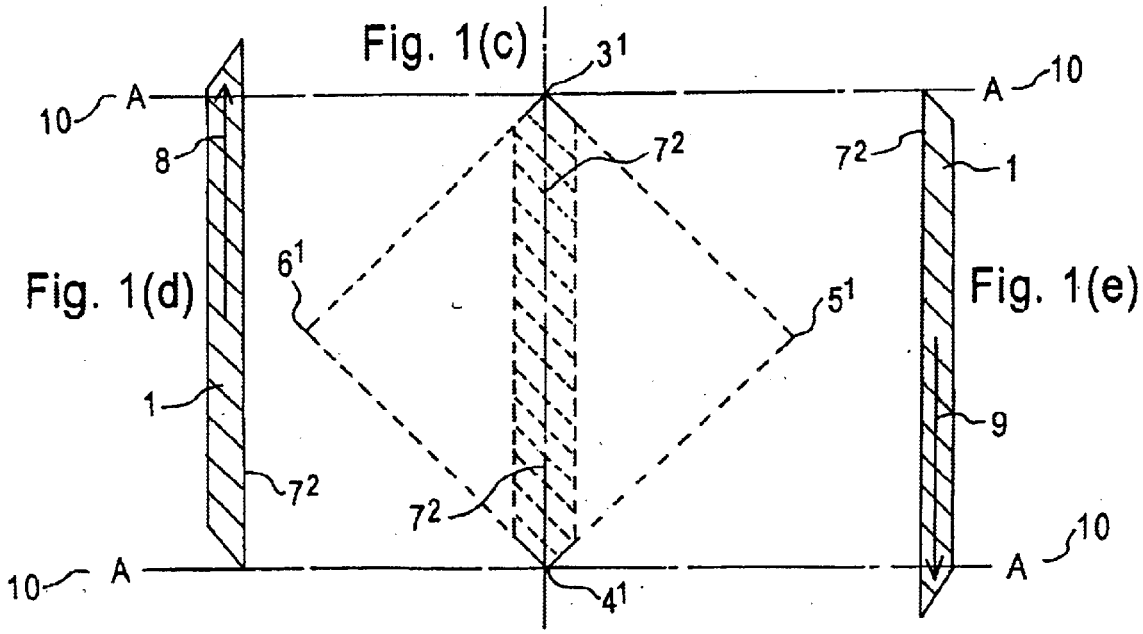
Fig. 1(d)
Fig. 1(e)

METHOD OF BONDING AND SEWING CLOTHS

BACKGROUND OF THE INVENTION AND RELATED ART STATEMENT

The present invention relates to a method of cutting a bias cloth with a stretchable function, and a method of sewing the a same.

Conventionally, a bias cloth extends longitudinally obliquely, and an extending drape or portion thereof is oblique relative to a warp weaving direction to form an unbalanced oblique drape. A hem or bottom line of a skirt, a bottom line of a jacket, and bottom lines of trousers are twisted to be laterally asymmetrical. Also, a bias tape used for sewing is formed of a unidirectional or one-way bias tape, and in a sewing machine, a unidirectional cloth feeding is used so that an upper front of sewing is backward feeding and a lower front is forward feeding. Thus, in sewing the bias tape by the sewing machine, one of them is either a reverse feeding or reverse stretching or extending, so that a twist phenomenon occurs.

However, in a conventional method of cutting a bias cloth or method of sewing the same, as shown in FIGS. 9(*a*) through 10(*c*), due to the oblique drape phenomenon, a warp direction of a center drape is strong and a weft direction thereof is weak, so that the center drape results in a biased drape. Furthermore, it is impossible to sew the bias laterally symmetrically since the seam is a twisted seam due to the feeding by the sewing machine.

Therefore, if a garment is sewn by the conventional method, as shown in FIG. 9(*c*), when a front button of a jacket is unfastened or a jacket is unbuttoned, front overlap portions are opened by obliquely twistingly falling, so that lower collar becomes an unstable shape and concaved, resulting in failing to keep the shapes of the lower collar.

Thus, according to the conventional cutting method and the sewing method, the concave or lowered down portion occur at the center of the lower collar and a three-dimensional collar with the collar turning line can not be made, so that the garment made by the aforementioned method is not finished beautifully.

Accordingly, an inventor of the invention has noticed a fact that there is a structure of the building in which a thick vertical column of the building and thin oblique columns thereof cross each other to strengthen a bridge or building such that a lateral distortion is supported by the columns as a whole.

Then, the inventor of the invention has considered whether the structure of the garment can prevent a twisting by sewing or wrinkles by washing, that is, a balanced structure supported by a principle of repulsion of the oblique crossing, to be achieved by sewing.

Namely, in case of sewing the cloths, the inventor of the invention tried to find a method in which a lateral or right and left deformation, which occurs at a sewn portion of the cloth by the one-way feeding by the sewing machine, and folding wrinkles, which occur at the time of washing, are recovered artificially as in a spring effect of the oblique crossing columns of the building.

Normally, the cloth is formed of warp and weft weaving, or is formed of warp knitting and weft knitting, and when the cloth structured as described above is sewn into a garment, the cloth tends to fall down vertically by the gravity, so that collar of the garment, such as a jacket of a suit, moves at a fold-over portion in an unstable condition by a force of falling down vertically from a neck point. Also, in the collar after washing, a middle folding portion of the collar falls downwardly by the gravity. By adopting the aforementioned principle, the main cloth is considered as the vertical column, and an oblique core piece with left-to-right bias is considered as the oblique column, and another core piece as a right-to-left bias is made to cross the main cloth.

Thus, by the method of crossing the left-to-right core piece and the right-to-left bias lining toward the warp weaving of the main cloth bias, a balance is maintained, and a collar cloth which tends to be flat by the gravity can keep a three-dimensional and soft form by the force of crossing the oblique cloths while keeping a roundness and having a three-dimensional shape. Therefore, as a result of studying how the column in crossing the oblique columns is obtained in case of cutting, bonding, and sewing the clothes, the present invention has been made.

Accordingly, an object of the invention is to provide methods of cutting, bonding, and sewing core pieces, tapes, and linings to woven fabric cloths, cut-and-sew type cloths, leather, and bias front cloths by utilizing crossing tensions of the left bias and right bias.

Further objects and advantages of the invention will be apparent from the following description of the invention.

SUMMARY OF THE INVENTION

To achieve the aforementioned objects, a first aspect of the present invention provides a method of cutting a woven cloth into a bias cloth, which comprises: cutting a cloth woven by warps and wefts vertical to the warp threads at 45 to 55 degrees into a left-to-right bias portion and a right-to-left bias portion as bias cloths to thereby achieve an one-directional stretchability for the right-to-left bias portion and the left-to-right bias portion as a bias front cloth, a bias adhesive core piece, a bias adhesive tape, and a bias lining.

In a method of bonding and sewing a bias core piece and a bias tape according to a second aspect of the invention, a left-to-right bias cloth for warps in a left-to-right bias direction and a right-to-left bias cloth for warps in a right-to-left bias direction (main cloths, core pieces, tapes and linings) are laminated to cross each other, and sewn together so that a return stretchability is maintained by a forward stretching and a backward stretching. Also, a forward stretching of the left-to-right bias tape is stretched forward by the sewing machine and feeding of the thread, and a right-to-left bias tape is stretched forward and sewn even by the forward feeding by the sewing machine, so that the left and right twisting and reverse turning phenomenon of the collar can be prevented.

According to a third aspect of the invention, in the method of sewing of the first and second aspects of the invention, right-to-left bias core pieces are respectively bonded to a front body portion of a jacket, a G collar or a lower collar, a facing, and an upper collar such that warp weaving portions of the respective bias core pieces are bonded in a right-to-left direction. Then, the front body, the G collar, the facing and the upper collar are sewn and turned inside out, so that a warp weaving of the core piece bonded to the body and a warp weaving of the core piece bonded to the facing diagonally cross each other to provide a stretch tension. Namely, the upper collar and the lower collar are supported by the crossing core pieces, and the body and the facing are supported by the crossing core pieces, resulting in a three-dimensional collar portion.

In a sewing method according to a fourth aspect of the invention, the bias adhesive core is bonded to an entire surface of a stretchable cloth having an unstable stretchability, such as a "Lycra" cloth having a large stretchability which can be stretched in vertical, lateral and diagonal directions, and a knit cloth (warp knitting or weft knitting), and by using bias adhesive core pieces and bias linings cut by a method of cutting the cloth according to one of the first through third aspects of the invention, the stretchable cloth and the knit cloth are cut and bonded.

A fifth aspect of the invention provides a method of forming a binder tape from a bias tape. When a binder tape made of a single main cloth is sewn, a twist phenomenon occurs. Namely, when the single cloth is folded and sewn by first stitches, reverse stretching phenomenon occurs at an upper surface cloth and a lower surface cloth. This is because the stretching of the upper surface cloth and the stretching of the lower surface cloth are opposite, resulting in a puckering in the binder tape. According to the fifth aspect of the invention, in order to prevent the aforementioned phenomenon, two binder tapes are provided, and one of them is formed of a left-to-right bias tape, and the other of them is formed of a right-to-left bias tape. Then, a "Lycra" stretchable tape is placed between the left-to-right bias tape and the right-to-left bias tape, and zigzag stitches are formed thereon. In the binder tape structured as described above, since the "Lycra" tape core is placed between the upper surface of the binder tape and the lower surface thereof, the upper surface and the lower surface in the binder tape provide a one-directional stretching, so that the binder tape is not twisted with sewing threads by the sewing machine.

When a garment is made by bias cloths, in the bias cloths woven by warps and wefts, by a twist phenomenon, a obliquely falling drape occurs. This is caused by a loosen weft weaving. As a method of correcting this phenomenon, a sixth aspect of the invention provides a method of correcting a twist phenomenon in cutting and sewing a bias cloth. In the method of correcting the twist phenomenon, an oblique, twisting deformation of the bias is corrected by a method of allowing a gravity of the cloth to fall down vertically. Namely, marks for sewing joint portions of a front panel and a back panel of the garment are displaced and sewn to thereby change the twist, resulting in correcting the twist in the garment which is not provided with linings.

According to the methods of cutting, bonding and sewing of the invention, in the bias front cloths, the bias core pieces, the bias lining, and the bias tapes made of the woven fabric cloth or the knit cloth, stretchability of the bias is formed of an elastic tension, and the elastic tension is divided into the left-to-right tension and the right-to-left tension. When the artificial tension or a feeding tension by the sewing machine is applied and released later, the bias cloth can be returned to the original shape.

Also, according to the present invention, by bonding the left-to-right bias core pieces to the body portion and the upper collar and by bonding the right-to-left bias core pieces to the facing and the G collar, the bias core pieces can be provided to the collar portion of the garment, so that the three-dimensional collar at a portion from the collar to the facing can be made by a bias elastic tension, and reverse warping of the collar and wrinkles after cleaning can be prevented. As a result, a beautiful three-dimensional collar can be formed, and the garment can be neatly sewn.

BRIEF DESCRIPTION OF THE DRAWINGS

FIGS. 1(*a*) through 1(*e*) are explanatory views schematically showing steps of a first method of cutting according to the present invention;

DETAILED DESCRIPTION OF THE PREFERRED EMBODIMENTS

Hereinafter, embodiments of the invention will be explained with reference to the attached drawings.

Figures 2A, 2B, 2C, 2D, 2E, 2F, 2G:
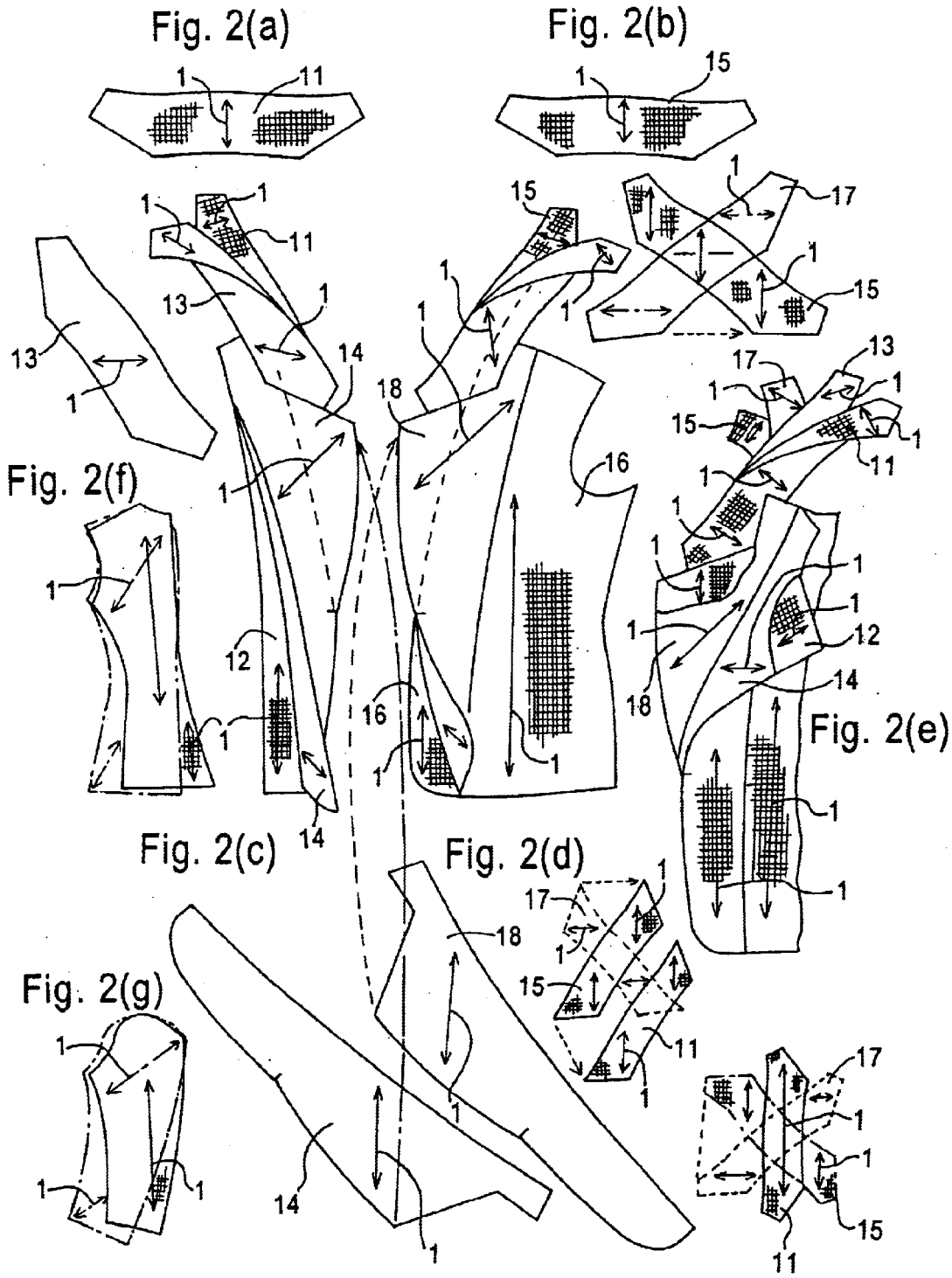
FIGS. 2(*a*) through 2(*g*) are explanatory views schematically showing steps of a second method of cutting according to the present invention.
Figure 6A:
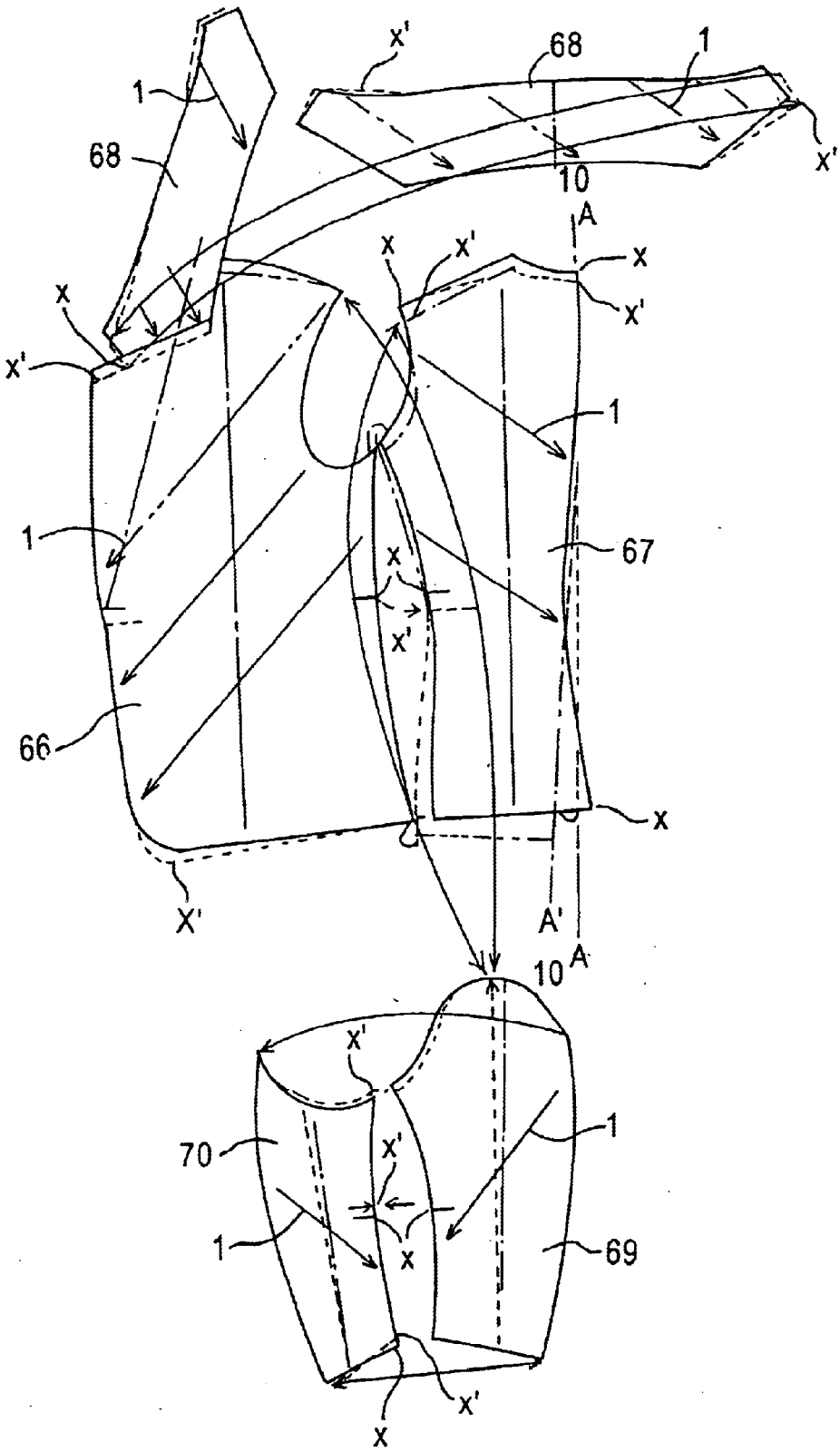
FIG. 6(*a*) is an explanatory view schematically showing a method of correcting a cutting according to the present invention.
Figure 7A:
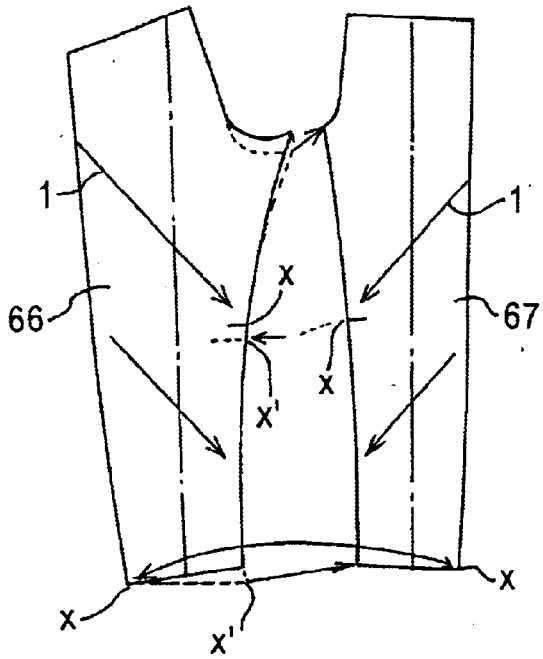
FIGS. 7(*a*) through 7(*d*) are explanatory views schematically showing the method of correcting the cutting according to the present invention.
Figure 7B:
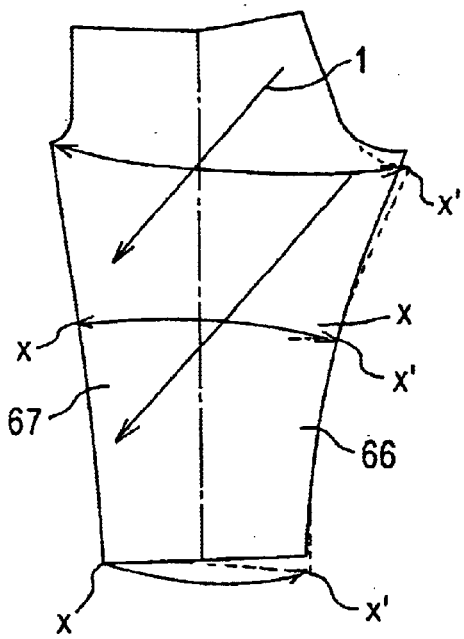
Figure 7C:
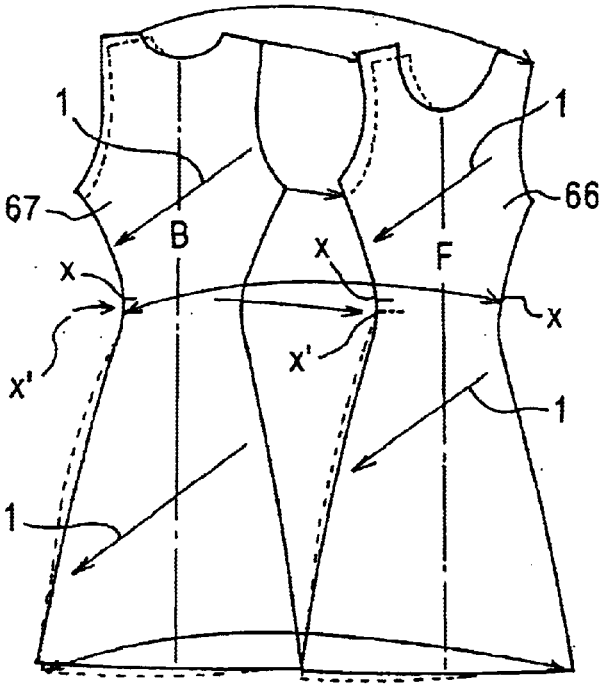
Figure 7D:
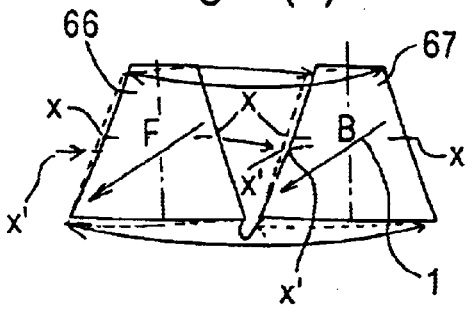
Figure 10A:
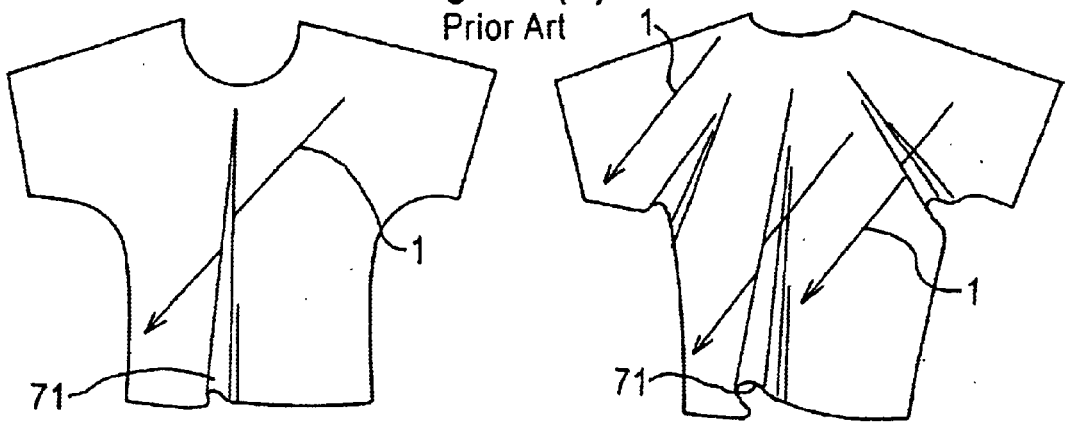
Fig. 10(a) Prior Art
FIGS. 10(*a*) through 10(*c*) are explanatory views schematically showing the twist phenomena in the garments sewn by the conventional sewing method.
Figure 10B:
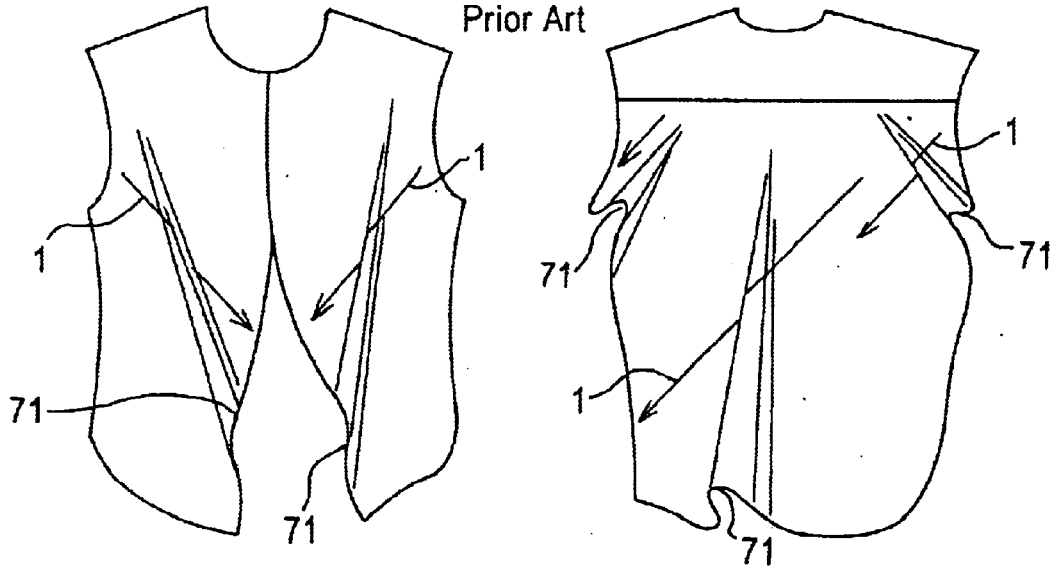
Fig. 10(b) Prior Art
Figure 10C:
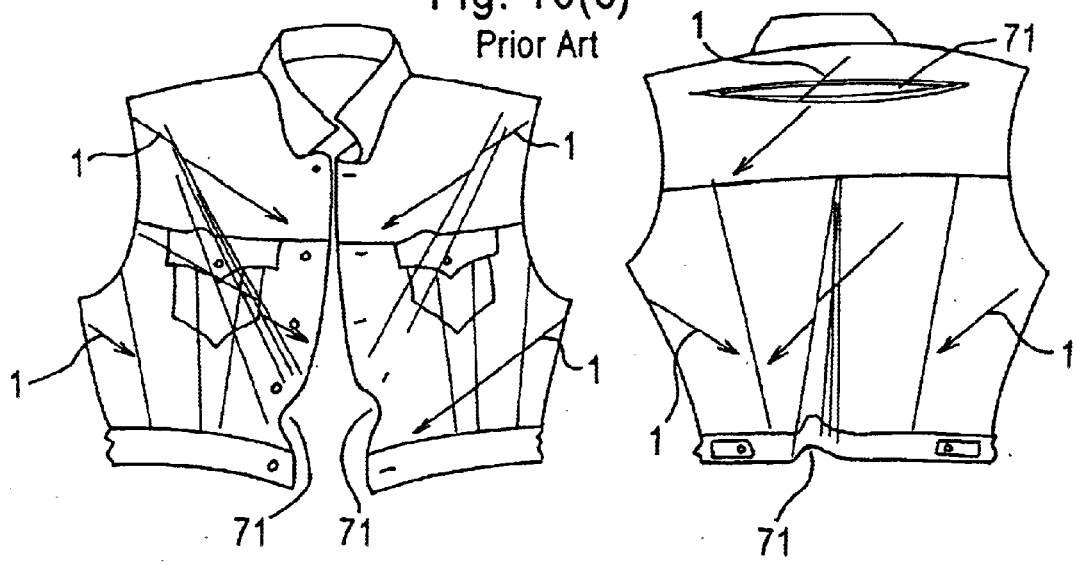
Fig. 10(c) Prior Art

FIGS. 1(*a*) through 1(*e*) are explanatory views schematically showing steps of a first method of cutting according to the present invention; FIGS. 2(*a*) through 2(*g*) are explanatory views schematically showing steps of crossing bias core piece and core piece biased with respect to woven fabric cloths by a second cutting method of the invention; and FIGS. 3(*a*) through 3(*c*) are explanatory views schematically showing steps of crossing core pieces and steps of bias crossing between the core piece and linings with respect to knit cloths by the second cutting method of the present invention. FIGS. 4(*a*) and 4(*b*) are explanatory views schematically showing a third cutting method of the invention, wherein FIG. 4(*a*) is a view for explaining a method of cutting left-to-right bias and right-to-left bias, in which a left bias adhesion tape and the right bias adhesion tape are shown, and FIG. 4(*b*) shows a cutting method for a jacket, in which core pieces are adhered to the cloth and cut at a left bias and a right bias. FIGS. 5(*a*) through 5(*c*) show binder woven cloth bias tapes; FIG. 5(*d*) shows bias tapes extending in two-directions from a center of a collar to joint a portion of the collar; FIG. 5(*e*) shows bias tapes crossing with a collar bias and bonded thereto; FIG. 5(*f*) shows a left-to-right bias tape and a right-to-left bias tape which are bonded to the jacket by the method in FIG. 5(*d*); and FIG. 5(*g*) is a view showing a step of bonding the bias core pieces in FIG. 2(*a*) through FIG. 3(*c*). FIGS. 6(*a*) through 8(*c*) are explanatory views showing a method of correcting twists in the bias cloths, and FIG. 9(*a*) through FIG. 10(*c*) are explanatory views for explaining oblique defected drapes due to twists 71 occurring in the conventional bias garments.

In the first cutting method of the invention, in case the woven fabric cloth, warps or longitudinal threads 1 of the cloth, and wefts or lateral threads 2 are cut, firstly, as shown in FIG. 1(*a*), the cloth is cut at 45 to 55 degrees to make it into a bias cloth. As shown in FIG. 1(*b*), the cloth is cut into two cloths with a longer length, and when the cloths are cut into bias tapes as shown in FIGS. 1(*d*) and 1(*e*), due to a feed plate of the sewing machine and thread sewing thereof, stretching of the tapes results in that a left tape 8 is stretched forwardly by the sewing machine, and a right tape 9 is stretched backwardly by the sewing machine. This is a discovery of a principle between sewing machine threads and a bias tape.

Further, a second cutting method of the invention is a method of cutting a body and sleeves of a woven fabric garment and a method of bonding, wherein adhesive bias core pieces 13, 14, 18 and a bias core piece 17 are subjected to warp weave bias crossing and bonded to jacket woven cloths 11, 12, 15 and 16 shown in FIGS. 2(*a*) through 2(*g*). A G collar 15 is crossed with a bias core piece 17 or an upper collar core piece 13 is crossed with a G collar bias core piece 17, and a body core piece 18 and a facing core piece 14 are crossed and bonded.

Figure 3A:
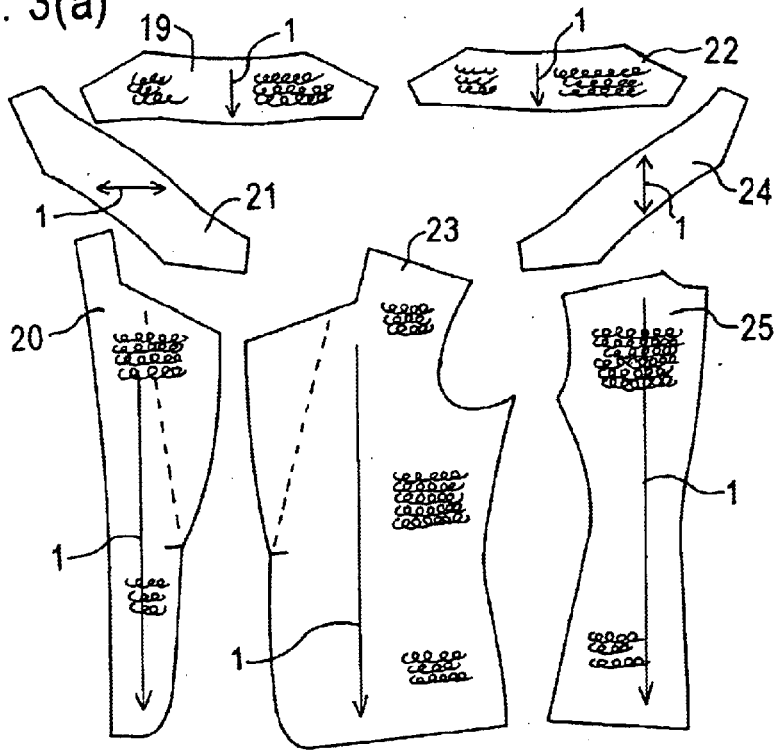
FIGS. 3(*a*) through 3(*c*) are explanatory views schematically showing steps of the second method of cutting according to the present invention.
Figure 3B:
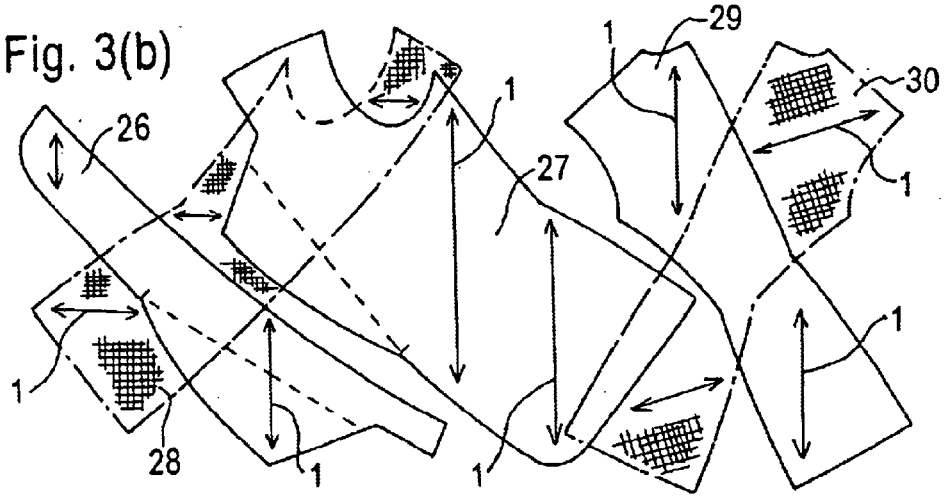
Figure 3C:
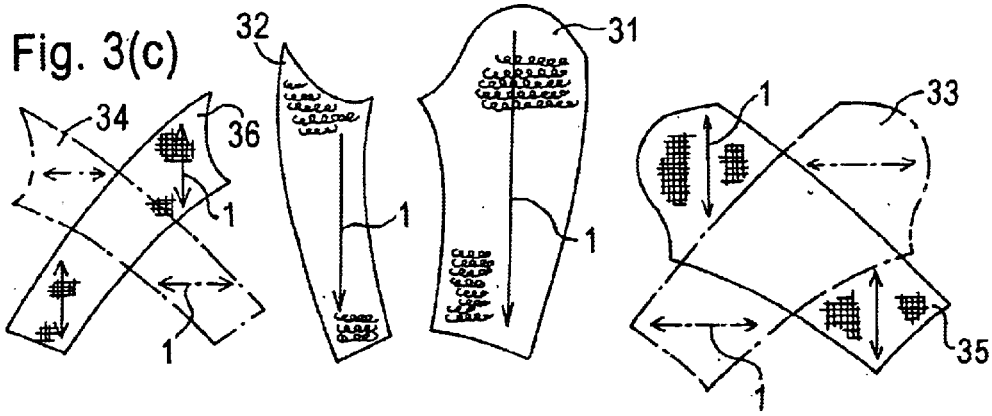
Figure 4A:
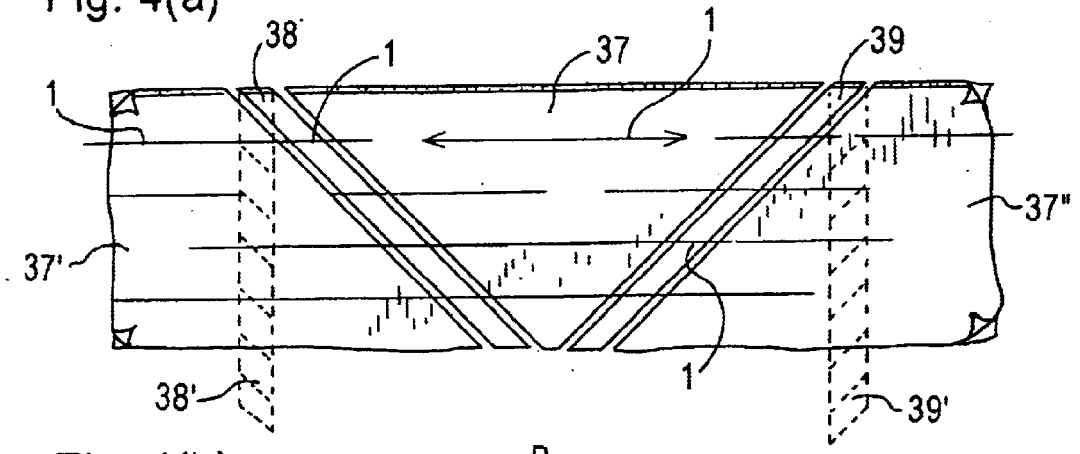
FIGS. 4(*a*) and 4(*b*) are explanatory views schematically showing steps of cutting adhesive bias tapes by a third cutting method according to the present invention.
Figure 4B:
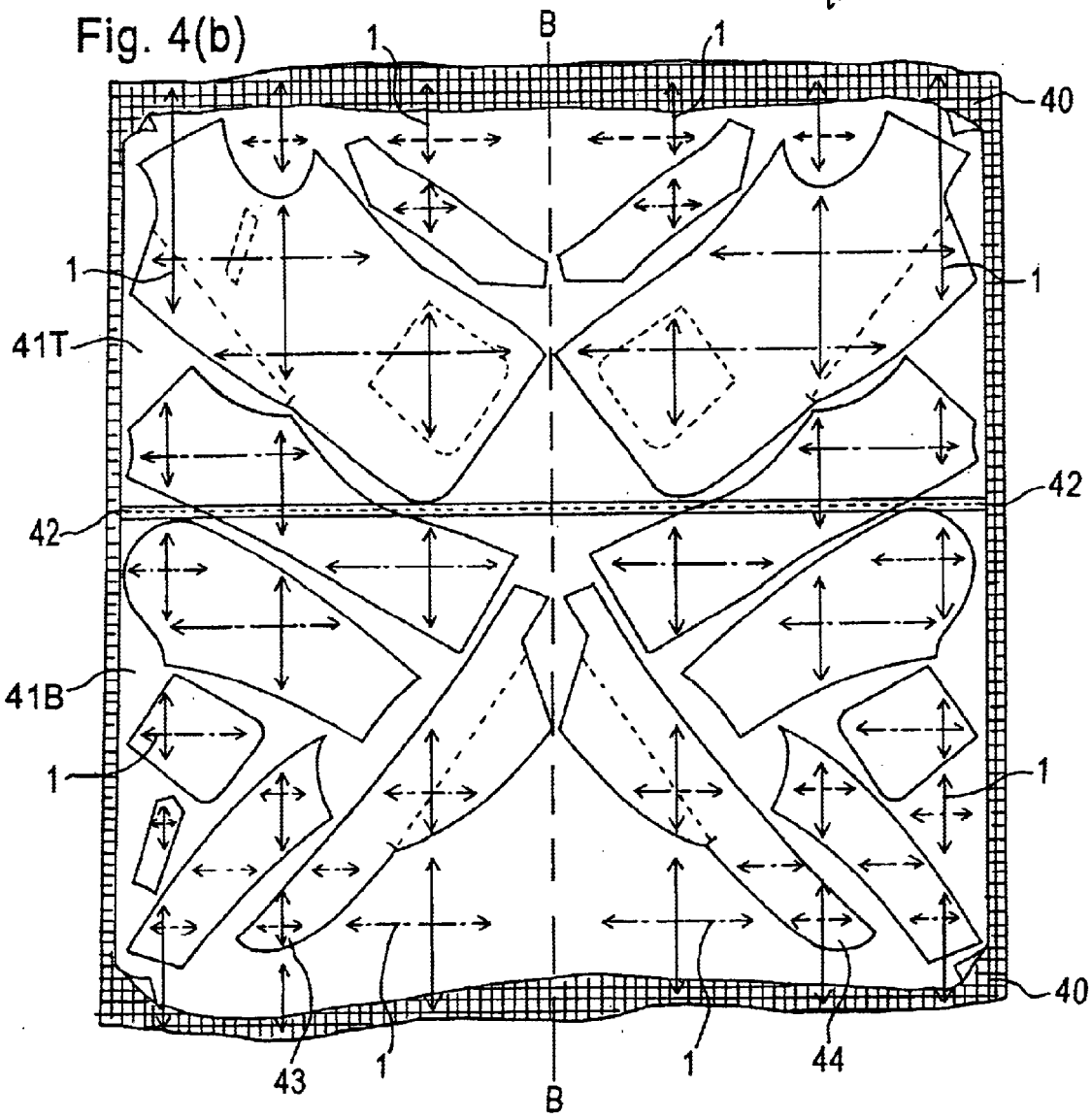
Figure 5A:
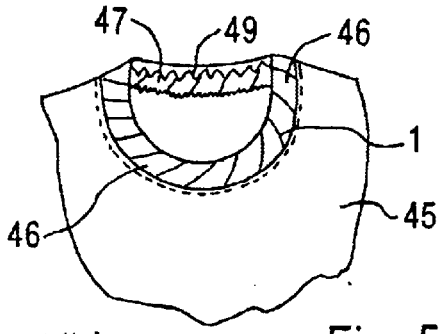
FIGS. 5(*a*) through 5(*g*) are explanatory views schematically showing steps of bonding and sewing, wherein FIGS. 5(*a*) through 5(*c*) are views showing binder tape sewing, FIGS. 5(*d*) through 5(*f*) are views showing a bonding of the core piece and the bias tape, and FIG. 5(*g*) is a view showing a step of bonding bias core pieces.
Figure 5B:
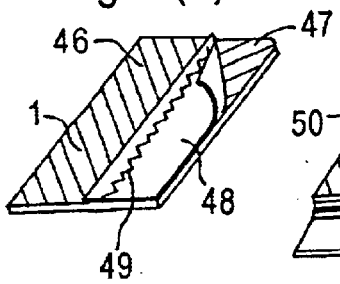
Figure 5C:
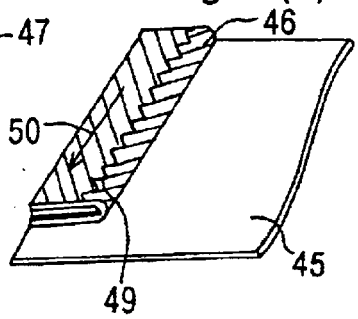
Figure 5F:
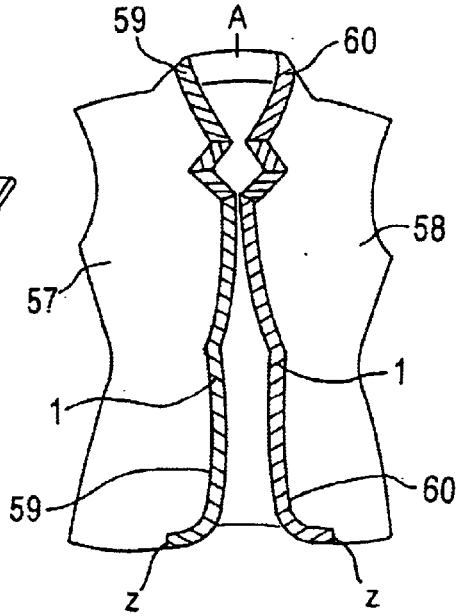
Figure 5D:
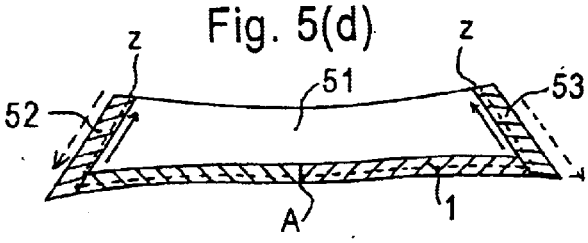
Figure 5E:
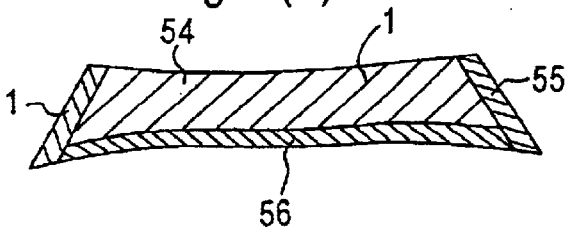
Figure 5G:
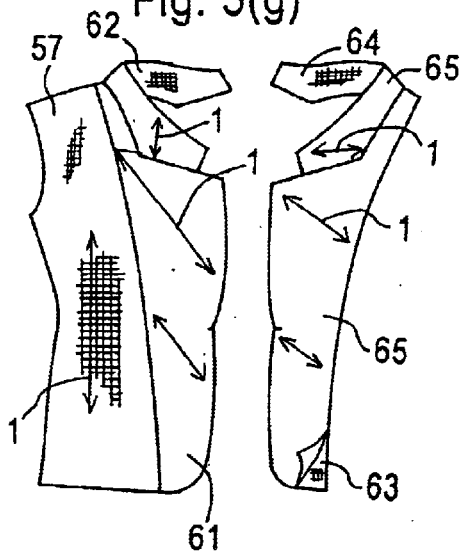

In FIGS. 3(*a*) through 3(*c*), knit cloths or stretchable cloths 19, 20, 22, 23, 25, 31 and 32 are cut as jacket main cloths, and bias adhesive core pieces 21, 24, 27, 29, 33 and 34 are cut. Then, bias linings 28, 30, 35, and 36 are cut. This cutting method is a bias crossing method, in which an upper collar core piece 21 and a lower collar core piece 24 are subjected to the bias crossing at warp weave sections; the body core piece 27 is subjected to the bias crossing together with a facing core piece 26 and a front body bias lining 28; the back lining 30 and the back core piece 29, which are subjected to the bias crossing with the body core piece 27 and a front body bias with a facing at bias warp weave sections, are subjected to the bias crossing; an upper sleeve core piece 33 and an upper sleeve lining 35 are subjected to the bias crossing; and a lower sleeve core piece 34 and a lower sleeve lining 36 are subjected to the bias crossing.

FIG. 4(*a*) shows a method of cutting two-directional tapes, and a woven fabric cloth having warps in a lateral direction is cut such that a left side 37' of an adhesive core piece 37 is cut into left-to-right bias tapes 38 and 38' having left-to-right bias directions, and a right side 37" of the core piece 37 is cut into right-to-left bias tapes 39 and 39' having right-to-left bias directions, to thereby form a left bias adhesive tape and a right bias adhesive tape.

Then, an upper lateral core piece 41T and a lower lateral core piece 41B, respectively having warps in a lateral or horizontal direction, are sewn at a sewing joint portion 42 to a woven longitudinal main cloth 40 having warps in a longitudinal or vertical direction in FIG. 4(*b*). The longitudinal main cloth 40 and a lateral adhesive core piece are bonded at the core pieces 41T and 41B and the sewing joint portion 42 such that the two cloths are made into single cloth. By using this single cloth made of the two cloths, a left bias 43 of a garment and a right bias 44 thereof are cut from the cloth, to thereby constitute a method of cutting the aforementioned stretchable bias two-directional tapes 38 and 39 and stretchable bias two-directional garment. According to the above method of the invention, it is possible to form a neckline main cloth of a T-shirt or an underwear in which a "Lycra" tape 48 is added to a bias left tape and a bias right tape shown in FIGS. 5(*a*), and the binder bias tapes 46 and 47 are sewn together with the Lycra tape 48 by zigzag stitches 49, and the binder bias tapes 46 and 47 are sewn to the main cloth 45 in the condition that the binder bias tapes 46 and 47 are stretched by 1/7 to 1/8 of the lengths thereof in a longitudinal direction 50 thereof.

In the invention, a bias cloth is directed according to a stretch feeding of the bias tape and a feed stretching by the sewing machine as shown in FIG. 5(*d*), wherein the bias tape are divided at a center point A of the collar 51 in a stretching direction of the bias to be a left stretching 52 and a right stretching 53, and the left stretching 52 and the right stretching 53 are sewn in the condition that they are stretched by 5 to 8% in the longitudinal direction thereof.

FIG. 5(*e*) shows a bonding method, wherein a bias left tape 55 and a bias right tape 56 are subjected to the bias crossing and laminated on a bias core piece 54.

FIG. 5(*f*) shows a method of bonding a left tape 59 to a left front body 57, and bonding a right tape 60 to a right front body 58. FIG. 5(*g*) shows a method of bonding, in which a left-to-right bias core piece 61 is bonded to a front body 57 and a left-right bias core piece 65 is bonded to a facing 63 and an upper collar 64, and when the front body and the facing are sewn and turned over, the aforementioned core pieces become a bias crossing core piece.

FIGS. 6(*a*) through 8(*c*) shows a method of correcting a cutting according to the present invention, wherein a twist phenomenon in a woven fabric bias cloth is corrected. Namely, between sewing joint marks x of a jacket front body 66 and a back body 67, one of the marks x is changed to a different position as a mark x' to thereby correct a twisted portion of the cloth. Then, one of marks x at shoulder joint portions are changed to a different position as a mark x' to correct a twisted portion of the cloth. Likewise, one of marks x at collar joint portions is corrected to a different position as a mark x', and one of marks x at sleeve joint portions is corrected to a different position as a mark x'.

Figure 8A:
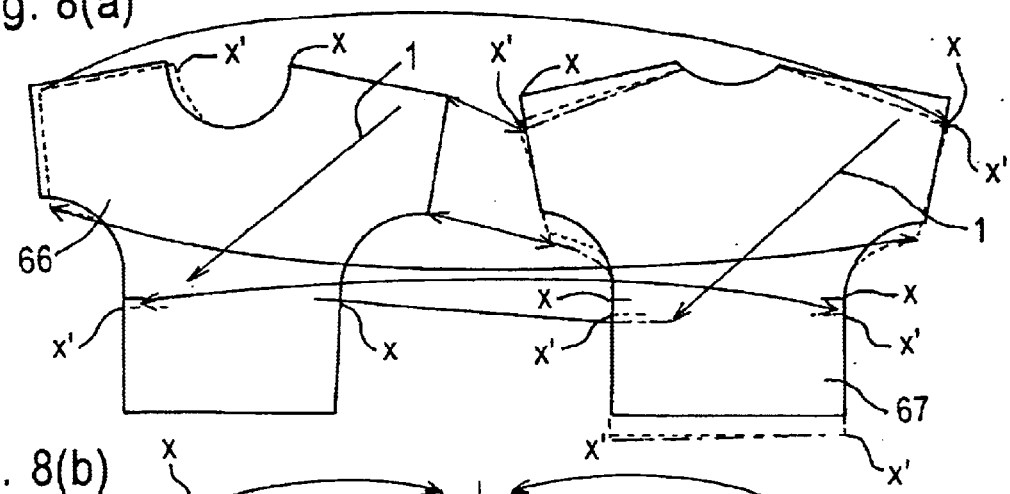
FIGS. 8 (*a*) through 8(*c*) are explanatory views schematically showing the method of correcting the cutting according to the present invention.
Figure 8B:
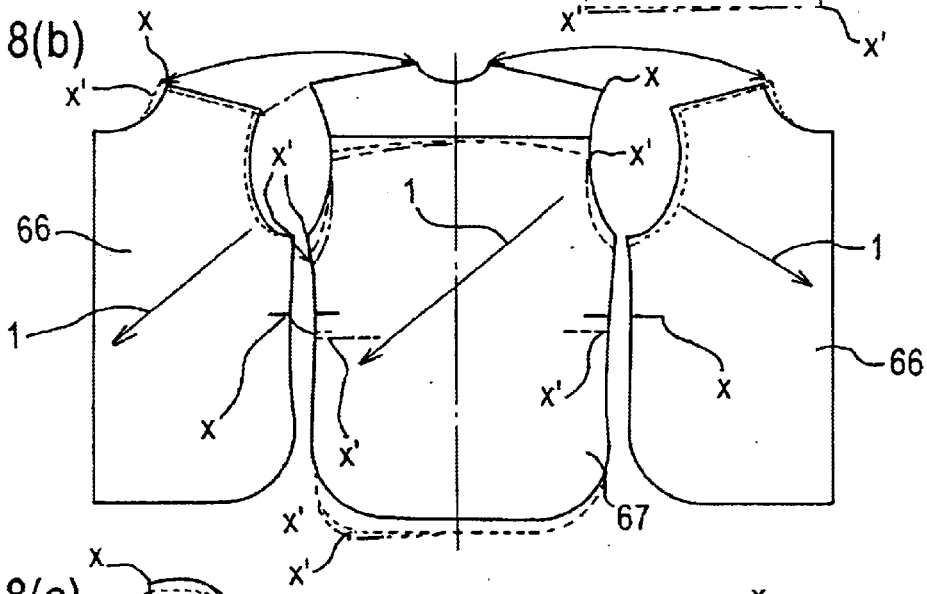
Figure 8C:
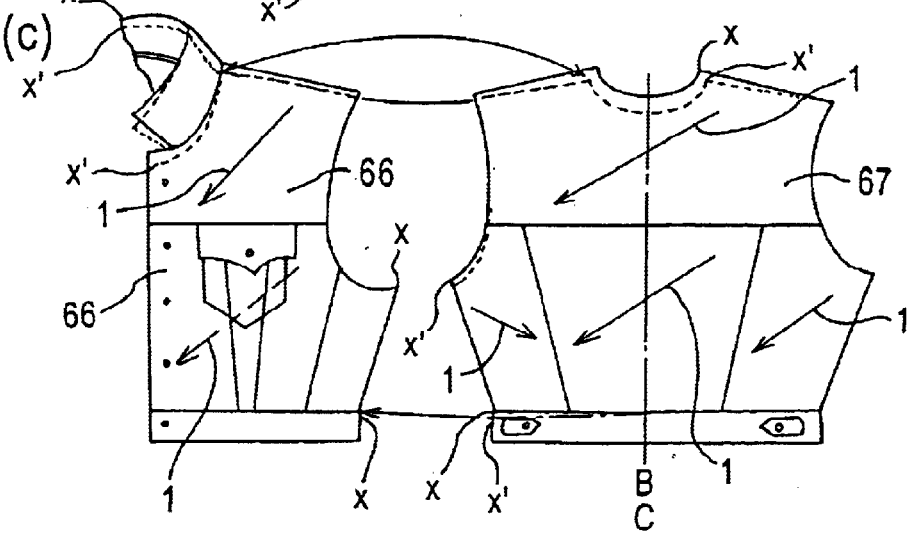
Figure 9A:
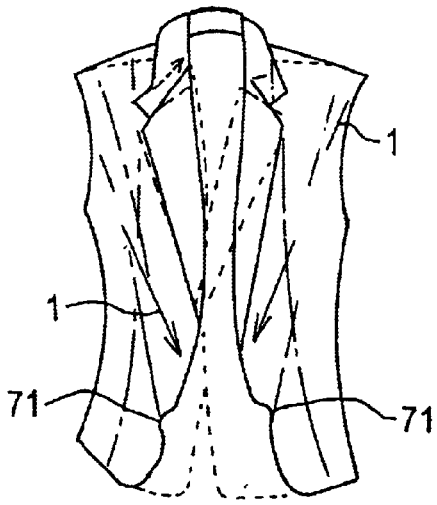
Fig. 9(a) Prior Art
FIGS. 9(*a*) through 9(*h*) are explanatory views schematically showing twist phenomena in garments sewn by a conventional sewing method.
Figure 9B:
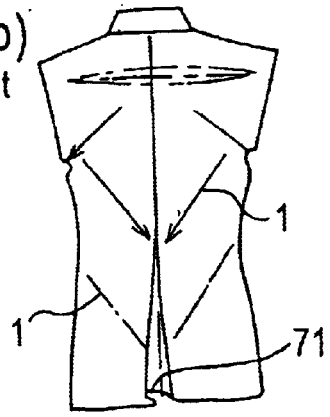
Fig. 9(b) Prior Art
Figure 9C:
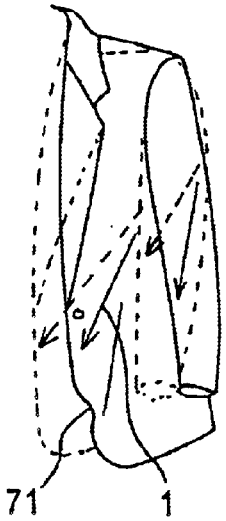
Fig. 9(c) Prior Art
Figure 9D:
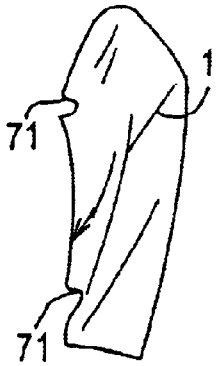
Fig. 9(d) Prior Art
Figure 9E:
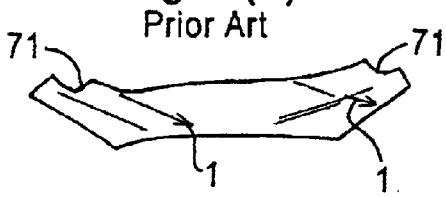
Fig. 9(e) Prior Art
Figure 9F:
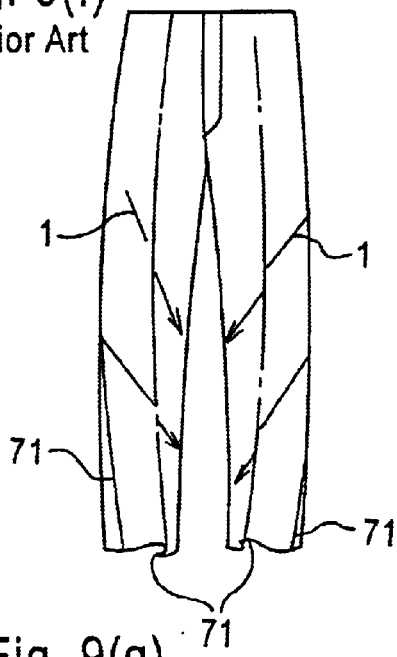
Fig. 9(f) Prior Art
Figure 9G:
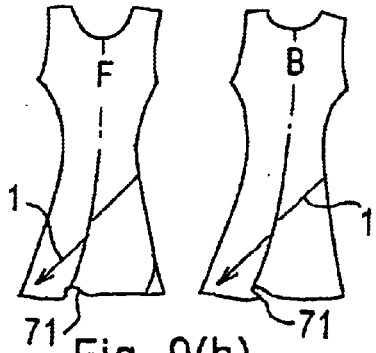
Fig. 9(g) Prior Art
Figure 9H:
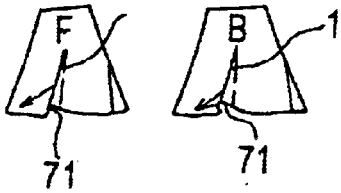
Fig. 9(h) Prior Art

In FIGS. 7(*a*) through 8(*c*), the aforementioned correcting method is used in a front panel 66 and a back panel 67 of each of various garments. FIGS. 7(*a*) and 7(*b*) show trousers, in which one of marks x of each pair at respective joint portions in the front panel 66 and the back panel 67 is corrected to a different position as a mark x', and in a dress shown in FIG. 7(*c*), a skirt shown in FIG. 7(*d*), a T-shirt shown in FIG. 8(*a*), a shirt in FIG. 8(*b*), and a jacket in FIG. 8 (*c*), twisted portions at sewing joint portions of the front panel and the back panel are corrected as in the trousers, so that the garment can be sewn without causing inner twisting of the bias cloth, such as inner twisting of a bias cloth trouser.

Hereinafter, although embodiments of the invention will be explained with reference to examples, the present invention is not limited thereto.

First Embodiment

As shown in FIG. 4(*a*), the bias cloth is divided into the left bias tape 38 and the right bias tape 39, and the bias adhesive two-directional stretching bias tapes can prevent twisting due to the thread sewing by a feed plate in one direction by the sewing machine, and the stretching of the bias tape prevents the cloth from twisting. Accordingly, the first embodiment is a bias tape used for left and a bias tape used for right in the garment.

FIG. 4(*b*) shows the left bias 43 used for the left side of the jacket and the right bias 44 used for the right side of the jacket. The left bias 43 and the right bias 44 are formed by bonding the lateral core pieces to the longitudinal cloth 40, and the longitudinal cloth and the lateral core pieces are made into the crossing core piece and are cut.

Second Embodiment

Firstly, as shown in FIGS. 5(*a*) through 5(*c*), the woven fabric binder tapes 46 and 47 are sewn to the main cloth 45 in the condition that the binder tapes 46 and 47 are stretched by 1/7 to 1/8 of their lengths in the longitudinal direction 50 thereof.

As shown in FIG. 5(*d*), a left advancing bias tape and a right advancing bias tape, which are divided from the point a into two directions, are bonded or attached to the collar main cloth 51 respectively in a tape left stretching direction and a tape right stretching direction to joint portions Z of a point open-necked collar, in which the left advancing tape has a leftward stretchability and the right advancing tape has a rightward stretchability.

Also, as shown in FIG. 5(*e*), in the bias collar cloth or bias core piece 54, left and right advancing bias tapes 56 and 55, or left stretching 56 and right stretching 55, are adhered to the collar cloth 54 to bias.

As shown in FIG. 5(*f*), the left-to-right bias tape or left advancing bias tape 59 is laminated on the left front body 57 and bonded thereto from a collar body left bottom line or end Z toward a center point A of a collar body neck portion in the condition that the bias tape 59 is stretched by 1/7 to 1/8 of the length thereof. Then, starting from the center point A of a collar body neck portion toward a collar body right bottom line or end Z, the right-to-left bias tape or the right advancing bias tape 60 is laminated on the right front body 58 and bonded thereto in the condition that the bias tape 60 is stretched by 1/7 to 1/8 of the length thereof.

Also, as shown in FIG. 5(*g*), the left-to-right bias core piece or left advancing bias core piece 61 toward a G collar 62 is laminated to the body 57 and bonded thereto. Then, the left-to-right bias core piece or left advancing core piece 65 toward the upper collar 64 is laminated on the facing 63 and bonded thereto, and when they are sewn, the core pieces result in the crossing core pieces, that is, the X crossing core piece.

In the garments including the collar front overlap portion of the collar facing section, which are cut, bonded, and sewn by the aforementioned methods of the invention, a front drooping phenomenon, a collar opening phenomenon above a button portion, a piling phenomenon, a twist phenomenon, and a obliquely falling and drape twisting phenomenon of the garments do not occur.

In case cloths woven from superfine fibers, such as Tactel or Tactele (made by E.I. Du Pont de Nemourse & Co., trade name) cloths (hereinafter referred to as a Tactel cloth), or very smooth cloths which are loose (drooping condition without restoring force) and wrinkled (not stretched tightly), such as cloths woven from rayon, are sewn to each other by the sewing machine, the twisting phenomenon occurs because sewing of the cloth by the sewing machine is one-direction sewing as described above, and the front overlapping or connecting portions of the collar of the garment requires the projecting tension. However, in the garment by the conventional methods, the collar facing is drooping, and front thereof is twisted. According to the methods of cutting, bonding and sewing of the invention, as a result of the tension by the bias and a tension by crossing the biases, the sewing of the above clothes by the sewing machine can be changed to the regular feeding without twisted sewing, and furthermore, the oblique drape in the average warp direction of the bias cloth can be corrected to the vertically downward drape.

Also, with respect to the woven fabric cloth and the knit cloth, the principle of the oblique drape can be utilized by the bias core piece and lining, and a three-dimensional collar is available by pulling the collar facing at the neck points by the oblique longitudinal cloth. Thus, a jacket made of the bias tension core pieces, the lining, and the tapes by the methods of the invention can be washed by water, and is not wrinkled and deformed easily. The woven fabric cloth is made to have the bias core piece tension, the knit is made to have the bias core piece and back tension, and the bias cloth is made to have the bias core and bias tapes, and linings.

While the invention has been explained with reference to the specific embodiments of the invention, the explanation is illustrative and the invention is limited only by the appended claims.

What is claimed is:

1. A method of bonding a bias piece, comprising:

providing a first bias cloth, laminating a second bias cloth on the first bias cloth and fixing thereto so that warps of the first bias cloth and warps of the second bias cloth cross each other, and fixing the first and second bias cloths to a stretchable cloth stretchable in vertical, lateral and diagonal directions so that the stretchable cloth is stably fixed with the first and second bias cloths.

2. A method of bonding a bias piece according to claim 1, wherein said first bias cloth is a left-to-right bias cloth having the warps in a left-to-right bias direction, and the second bias cloth is a right-to-left bias cloth having the warps in a right-to-left bias direction.

3. A method of bonding a bias piece according to claim 1, wherein said stretchable cloth is a stretchable tape, said first and second bias cloths are cut into bias tapes, and said bias tapes being stitched to said stretchable tape with zigzag stitches to thereby form a binder tape stretching in one direction.

4. A method of bonding a bias piece according to claim 3, wherein said binder tape is provided on a garment at a neckline, a periphery of a collar, a periphery of a sleeve, or a periphery of a bottom line.

5. A method of bonding a bias piece comprising:

providing a stretchable cloth which is stretchable in vertical, lateral and diagonal directions with unstable stretchability, laminating a bias cloth, which is a bias adhesive core piece, on the stretchable cloth, and fixing the bias cloth to the stretchable cloth so that the bias cloth is stably fixed with the stretchable cloth and bonded to an entire surface of the stretchable cloth, said bias adhesive core piece being arranged and fixed to a bias lining such that warps of the bias core piece and warps of the bias lining cross each other, said bias core piece bonded to the stretchable cloth and the bias lining providing a bias tension to the stretchable cloth.

* * * * *